US012766589B2

(12) United States Patent
Schaeffer et al.

(10) Patent No.: US 12,766,589 B2
(45) Date of Patent: Oct. 20, 2026

(54) SONOTRODE, SYSTEM AND METHOD OF RESHAPING A CONNECTING ELEMENT

(71) Applicant: HERRMANN ULTRASCHALLTECHNIK GMBH & CO. KG, Karlsbad (DE)

(72) Inventors: Marshall Schaeffer, Algonquin, IL (US); Robert DeCoursey, Saint Charles, IL (US)

(73) Assignee: Herrmann Ultraschalltechnik GmbH & Co. KG, Karlsbad (DE)

( * ) Notice: Subject to any disclaimer, the term of this patent is extended or adjusted under 35 U.S.C. 154(b) by 0 days.

(21) Appl. No.: 18/955,042

(22) Filed: Nov. 21, 2024

(65) Prior Publication Data

US 2026/0138178 A1 May 21, 2026

(51) Int. Cl.
*B21J 15/04* (2006.01)

(52) U.S. Cl.
CPC ..... *B21J 15/04* (2013.01)

(58) Field of Classification Search
CPC ..... B21J 15/04; B29C 65/606; B29C 65/568
See application file for complete search history.

(56) References Cited

U.S. PATENT DOCUMENTS 3,754,310 A * 8/1973 Shea ..... F16B 19/10 264/249
5,056,207 A * 10/1991 Ladouceur ..... B23P 19/062 29/512
2016/0243754 A1* 8/2016 Wallner ..... F16B 19/06

FOREIGN PATENT DOCUMENTS

JP 2006088415 A * 4/2006 ..... B29C 66/8322
WO 2023084046 A1 5/2023

OTHER PUBLICATIONS

Machine Translation of JP2006-088415A (Year: 2006).*

* cited by examiner

*Primary Examiner* — Daniel Mcnally
(74) *Attorney, Agent, or Firm* — Hudak, Shunk & Farine Co LPA

(57) ABSTRACT

A sonotrode and a method for reshaping a connecting element to form a closing head of a rivet. The sonotrode includes a cavity for forming the closing head, the sonotrode defines a longitudinal axis, the cavity provides a contact surface including two opposing side surface sections and at least two ridges protruding from each of the opposing side surface sections in an alternating manner. The method includes providing a connecting element defining a normal axis and two opposing side faces, providing a sonotrode, wherein the longitudinal axis of the sonotrode is aligned with the normal axis of the connecting element, moving the sonotrode and the connecting element towards each other, thereby initially bringing the ridges in contact with the side faces, applying an ultrasonic vibration via the sonotrode to the connecting element, thereby initially softening or melting the material of the connecting element in the region of initial contact.

20 Claims, 6 Drawing Sheets

SONOTRODE, SYSTEM AND METHOD OF RESHAPING A CONNECTING ELEMENT

FIELD OF THE INVENTION

The invention relates to a sonotrode for reshaping a connecting element to form a closing head of a rivet, a system comprising the connecting element in the form of a rivet and the sonotrode, and a method of reshaping a connecting element to form a closing head.

BACKGROUND OF THE INVENTION

The method according to the invention belongs, in general, to pressure reshaping processes making use of a reshaping tool with an upsetting surface that is brought in contact with the material of the connecting element to be reshaped. The upsetting surface is herein also called contact surface. The contact surface is, more precisely, the inner surface of a cavity or die formed into the reshaping tool. During the reshaping process a force is applied and the reshaping tool and the connecting element are moved relatively towards each other whereby the material of the connecting element at least partially fills the cavity. In this way the closing head receives a positive shape corresponding to the negative shape of the cavity. The process can also be referred to as upsetting in an open die.

The method further makes use of ultrasonic vibration in order to at least partially heat the connecting element, thereby locally softening or melting the material of the connecting element before and/or while the force is applied to the reshaping tool to execute the reshaping process as described above. The ultrasonic vibration is applied via the reshaping tool itself which, therefore, is also called a sonotrode. More precisely a vibration between about 15 kHz and about 10 GHz is applied to the workpiece.

From International Patent Application No. WO 2023/084046 a sonotrode for reshaping a connecting element is known comprising a cavity at least partially having the negative shape of the closing head to be formed, wherein the cavity provides a contact surface designed to come in contact with the connecting element during reshaping, wherein the sonotrode defines a longitudinal axis along which the sonotrode and the connecting element are movable relative to each other, and wherein the contact surface in a cross section in at least one first plane parallel to the longitudinal axis comprises a first contour with a convex shaped outer section, so that a line connecting two points within the convex shaped outer section extends through the sonotrode and not through the cavity.

Also, indentations placed on a radially outer section of the contact surface are known from this patent application. The indentations provide radially protruding features on the outer circumference of the reshaped rivet head, thereby forming what is called the "bundt cake" design.

The known sonotrode design contributes to accelerate and improve the reshaping process by:

1. direct created melt towards the connecting element so it stays close to the outer circumferential surface thereof and assists subsequent melting by pre-heating and thus raises the ultrasonic heat dissipation increasing the damping of the material, which accelerates ultrasonic heating and strengthens the bond between the closing head and the remaining post ("melt acceleration"),
2. direct created melt away from the sonotrode so it gives less of its thermal energy to the sonotrode, and therefore does not need as much or any reheating throughout the rest of the staking process,
3. reduce the amount of plastic which must be melted to form the rivet head while providing a sufficiently large closing head diameter for a secure fixation of the elements to be joined and
4. accelerate cooling of the closing head after reshaping ("cooling acceleration").

Based on the described state of the art, the object of the present invention is to provide a sonotrode, a system and a method for reshaping a connecting element, which further helps to minimize the time to melt and reform the connecting element thereby affecting the overall cost of the process.

SUMMARY OF THE INVENTION

The object according to a first aspect of the invention is solved by a sonotrode for reshaping a connecting element to form a closing head of a rivet, the sonotrode comprising a cavity at least partially having the negative shape of the closing head to be formed, wherein the sonotrode defines a longitudinal axis, wherein the cavity is generally ring-shaped and provides a contact surface designed to come in contact with the connecting element during reshaping, the contact surface comprising a radially outwardly facing inner surface section and a radially inwardly facing outer surface section, and wherein the contact surface comprises at least two internal ridges oriented substantially in the direction of the longitudinal axis and protruding radially outwardly from the inner surface section.

According to a second aspect of the invention the object is solved by a sonotrode for reshaping a connecting element to form a closing head of a rivet, wherein the connecting element defines a center axis and is at least partially formed by a tubular wall with an inner circumferential face, an outer circumferential face and an end face, the sonotrode comprising: a cavity at least partially having the negative shape of the closing head to be formed, wherein the sonotrode defines a longitudinal axis being able to be aligned with the center axis of the connecting element; wherein the cavity is generally ring-shaped and provides a contact surface designed to come in contact with the connecting element during reshaping, the contact surface comprising a radially outwardly facing inner surface section and a radially inwardly facing outer surface section; wherein the contact surface comprises at least two internal ridges oriented substantially in the direction of the longitudinal axis and protruding radially outwardly from the inner surface section; and wherein the at least two internal ridges are configured to make the first contact with the inner circumferential face during reshaping.

A preferred embodiment of the invention further comprises at least two external ridges oriented substantially in the direction of the longitudinal axis and protruding radially inwardly from the outer surface section, wherein the at least two external ridges are also configured to make the first contact with the outer circumferential face during reshaping.

The invention also includes a system comprising a connecting element and a sonotrode according to the first or second aspect, wherein the connecting element defines a center axis and being at least partially formed by a tubular wall with an inner circumferential face, an outer circumferential face and an end face; wherein the longitudinal axis of the sonotrode is aligned with the center axis of the connecting element; wherein the sonotrode and the connecting element are arranged to be movable along the longitudinal axis relatively to each other; and wherein the least two internal ridges are configured to make the first contact with the inner circumferential face when the sonotrode and the connecting element are moved relatively towards each other.

According to a third aspect of the invention the object is solved by a sonotrode for reshaping a connecting element to form a closing head of a rivet comprising: a cavity at least partially having the negative shape of the closing head to be formed; wherein the sonotrode defines a longitudinal axis; wherein the cavity provides a contact surface designed to come in contact with the connecting element during reshaping, the contact surface comprising two opposing side surface sections; and wherein the contact surface comprises at least two ridges protruding from each of the opposing side surface sections in an alternating manner, the ridges being oriented substantially in the direction of the longitudinal axis.

The invention also includes a system comprising a connecting element and a sonotrode according to the third aspect, wherein the connecting element defines a normal axis and being at least partially formed by an elongated wall with two opposing side faces and an end face; wherein the longitudinal axis of the sonotrode is aligned with the normal axis of the connecting element; wherein the sonotrode and the connecting element are arranged to be movable along the longitudinal axis relatively to each other; and wherein the least two ridges on each of the opposing side surface sections are configured to make the first contact with the opposing side faces when the sonotrode and the connecting element are moved relatively towards each other.

According to a fourth aspect of the invention the object is solved by a method of reshaping a connecting element to form a closing head of a rivet, the method comprising: providing a connecting element, the connecting element defining a center axis and being at least partially formed by a tubular wall with an inner circumferential face, an outer circumferential face and an end face; providing a sonotrode according to the first or second aspect, wherein the longitudinal axis of the sonotrode is aligned with the center axis of the connecting element; moving the sonotrode and the connecting element along the longitudinal axis relatively towards each other, thereby initially bringing the at least two internal ridges in contact with the inner circumferential face, applying an ultrasonic vibration via said sonotrode to the connecting element thereby initially softening or melting the material of the connecting element in the region of the initial contact.

According to a fifth aspect of the invention the object is solved by a method of reshaping a connecting element to form a closing head of a rivet, the method comprising: providing a connecting element, the connecting element defining a normal axis and being at least partially formed by an elongated or strip-shaped wall with two opposing side faces and an end face; providing a sonotrode according to the third aspect, wherein the longitudinal axis of the sonotrode is aligned with the normal axis of the connecting element; moving the sonotrode and the connecting element along the longitudinal axis relatively towards each other, thereby initially bringing the at least two ridges on each of the opposing side surface sections in contact with the opposing side faces, applying an ultrasonic vibration via said sonotrode to the connecting element thereby initially softening or melting the material of the connecting element in the region of the initial contact.

Ultrasonic vibrations according to known sonotrode designs and reshaping methods upon a first contact between the sonotrode and the connecting (or joining) element are generally applied to the end face (or top) of the connecting element and are often intended to be uniformly applied across the top. This also applies to the teaching of International Patent Application No. WO 2023/084046 according to which the contact surface is arranged to initially get in contact with the connecting element at the end face thereof or at least in a transition section between the outer circumferential face and the end face, when the sonotrode and the connecting element are moved relatively towards each other. As a consequence, the contact surface of the sonotrode initially only interacts with a small portion of the top of the connecting element. This limits ultrasonic power input to only the top thereof, which limits the process speed.

In contrast, the invention provides for a sonotrode design that enables an initial contact between the contact surface and the connecting element to be made along the side face thereof, i.e. before any contact is made with the end face thereof. Particularly, if a connecting element formed by a tubular wall (also called hollow post) is to be reshaped initial contact is made along the inner and preferably also along the outer circumferential face thereof. Likewise, when a connecting element formed by an elongated or strip-shaped wall (also called tab) is to be reshaped initial contact is made along the opposing side faces thereof. The sonotrode for this purpose exhibits said ridges being nearly parallel to the longitudinal axis of the sonotrode, i.e. having crown sections oriented in a plane parallel to the longitudinal axis and being inclined by a draft angle in a range from >0° to 15°, preferably in a range from >0° to 10°, relative to the longitudinal axis. For reshaping a hollow post, the ridges preferably protrude at least from the inner surface section or from the inner and outer surface sections, in the range between 0.1 mm and 2.0 mm, more preferably in the range between 0.2 mm and 0.6 mm, thereby interfering with the inner or inner and outer circumferential face of the hollow post before the end face thereof gets in contact with the bottom surface section of the contact surface. Likewise, for reshaping a tab, the ridges protrude from each of the opposing side surface sections in an alternating manner, also in the range between 0.1 mm and 2.0 mm, more preferably in the range between 0.2 mm and 0.6 mm, thereby interfering with the opposing side faces of the tab before the end face thereof gets in contact with the bottom surface section of the contact surface.

The initial contact thus occurs at an earlier point in the relative movement between the sonotrode and the connecting element. The time span or stroke movement from the initial contact to the contact between the bottom surface section of the contact surface and the end face of the connecting element is used to already transfer heat to the inner, outer or opposing surfaces of the connecting element. In this way, the material of the connecting element is already pre-softened and ready to be reformed before contact between the bottom surface section of the contact surface and the end face of the connecting element is established. In addition, the ridges interfere with the joining element in multiple locations thereby providing a larger initial contact area than the known sonotrodes. The sonotrode thus can input increased power for melting the joining element and, compared to known designs, allows similar joining results in less time and with lower cost.

If the sonotrode for reshaping a hollow post further comprises additional external ridges oriented substantially in the direction of the longitudinal axis and protruding radially inwardly from the outer surface section, preferably, the internal ridges and the external ridges are arranged in an alternating manner with respect to a circumferential direction. Similar to the sonotrode for reshaping a tab, the ridges are patterned such that tracing along the inner and outer surface sections there will be alternation of ridges interfering with the outer and inner diameters, respectively. In the case of the ring-shaped geometry, the inner and outer surfaces sections correspond to the opposing side surface sections of the strip-shaped geometry. Adding ridges to interact with opposing sides faces or circumferential faces turned out to be more practical and effective with regard to uniform heating than doubling input locations on one side of the connecting element. The alternating positioning of the ridges also helps to fix the hollow post or the tab in its position and to press the softened material into the contour of the opposing side face section or circumferential face section. Furthermore, the interfering ridges have the advantage of improving heat transfer out from the center of the molten material during the cooling phase of the staking process, which is understood to reduce the required cooling time.

For the same reason, preferably, the angular distances between all neighboring inner and outer ridges around the longitudinal axis are equal. Also, the number of inner ridges and outer ridges is preferably equal. Likewise, the distances between the alternating ridges on both side surfaces sections are equal. The ridges being evenly distributed over the contact surface divide the melt into even portions, helping each region of the final stake to have the proper amount of melt flowing to form it.

In one embodiment, the invention further provides for a number of indentations being formed into the outer surface section, wherein the numbers of indentations and of inner ridges is equal and wherein the angular positions with respect to the longitudinal axis of the indentations and of the inner ridges is equal. If there are external ridges protruding from the outer surface section the indentations are preferably formed between each pair of neighboring outer ridges.

According to another embodiment a width of the internal ridges in the circumferential direction is wider than a width of the external ridges in the circumferential direction.

According to yet another embodiment the internal ridges and the external ridges extend in the direction of the longitudinal axis over a length of between 1.0 mm and 10.0 mm, more preferably in the range between 1.5 mm and 8.0 mm. The ridges thus allow the sonotrode to interact with the side faces or the circumferential faces reaching down up to 10 mm.

According to one embedment of the method the contact surface further comprises a bottom surface section, wherein after initial contact the sonotrode and the connecting element are further moved along the longitudinal axes relatively towards each other, thereby bringing the end face of the connecting element in contact with the bottom surface section.

According to yet another embodiment of the method after bringing the end face of the connecting element in contact with the bottom surface section the sonotrode and the connecting element are further moved along the longitudinal axis relatively towards each other, thereby direct softened material or melt to flow along the outer circumferential face of the connecting element.

BRIEF DESCRIPTION OF THE DRAWINGS

Further advantages, features and effects are described below with reference to the drawings. Therein:

FIG. 1 shows a sonotrode 1 having an essentially cylindrical circumference. The sonotrode 1 defines a longitudinal axis 2 in this embodiment coinciding with the cylinder axis. The sonotrode 1 comprises a cavity 3 having the negative shape of the closing head to be formed. The cavity 3 is generally ring-shaped having a five-fold symmetry axis with respect to the longitudinal axis 2.

Figure 1:
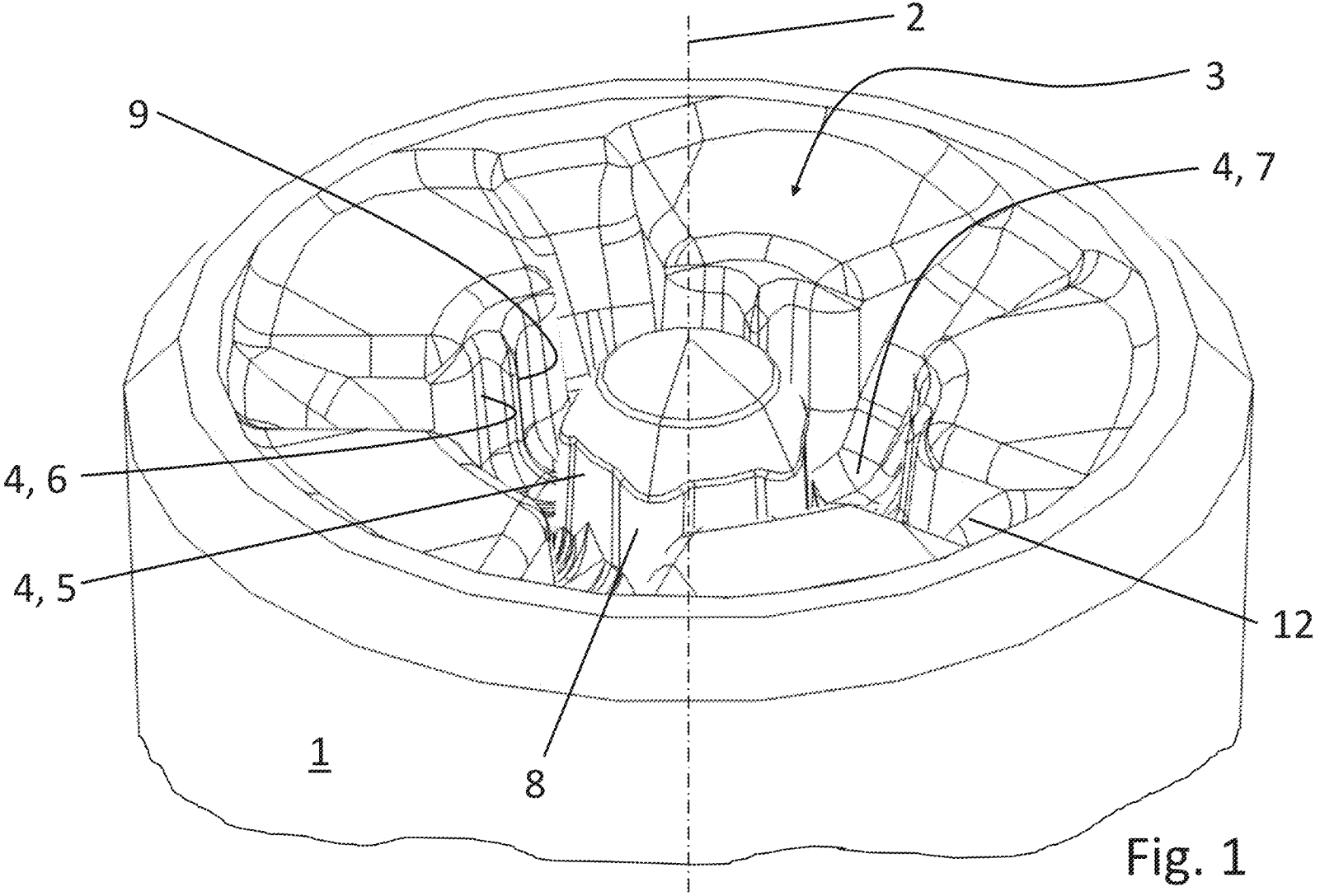
FIG. 1 illustrates a first embodiment of the sonotrode in accordance with the invention in a perspective sectional view.

The cavity 3 provides a contact surface 4 designed to come in contact with the connecting element during reshaping. The contact surface 4 comprises a radially outwardly facing inner surface section 5, a radially inwardly facing outer surface section 6 and a bottom surface section 7 facing basically in the direction of the longitudinal axis 2. The contact surface 4 further comprises five internal ridges 8 oriented substantially in the direction of the longitudinal 2 axis and protruding radially outwardly from the inner surface section 5. The contact surface further comprises five external ridges 9 oriented substantially in the direction of the longitudinal axis 2 and protruding radially inwardly from the outer surface section 6.

Figure 2:
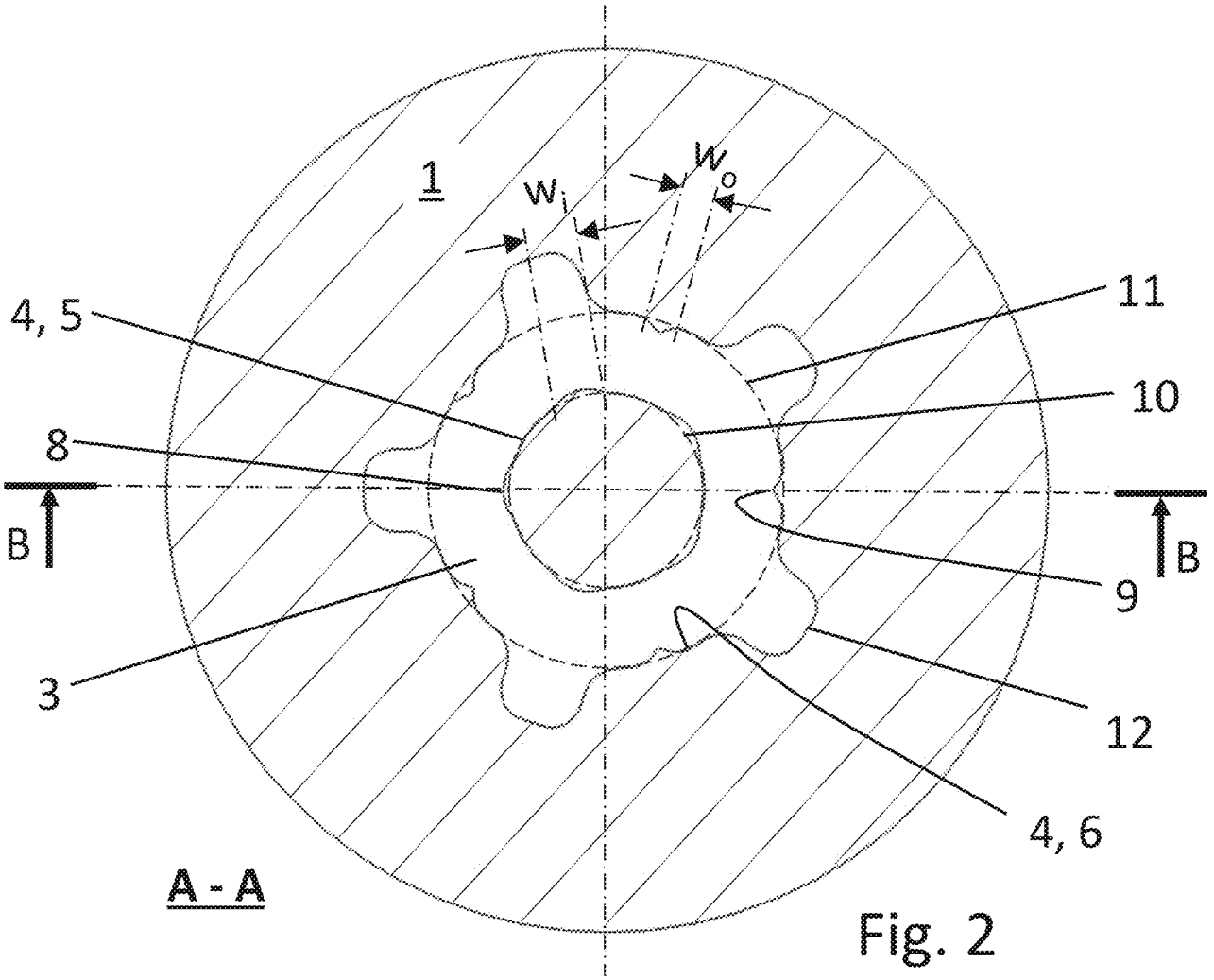
FIG. 2 illustrates a cross section A-A through the sonotrode according to FIG. 1 in a horizontal plane.
Figure 3:
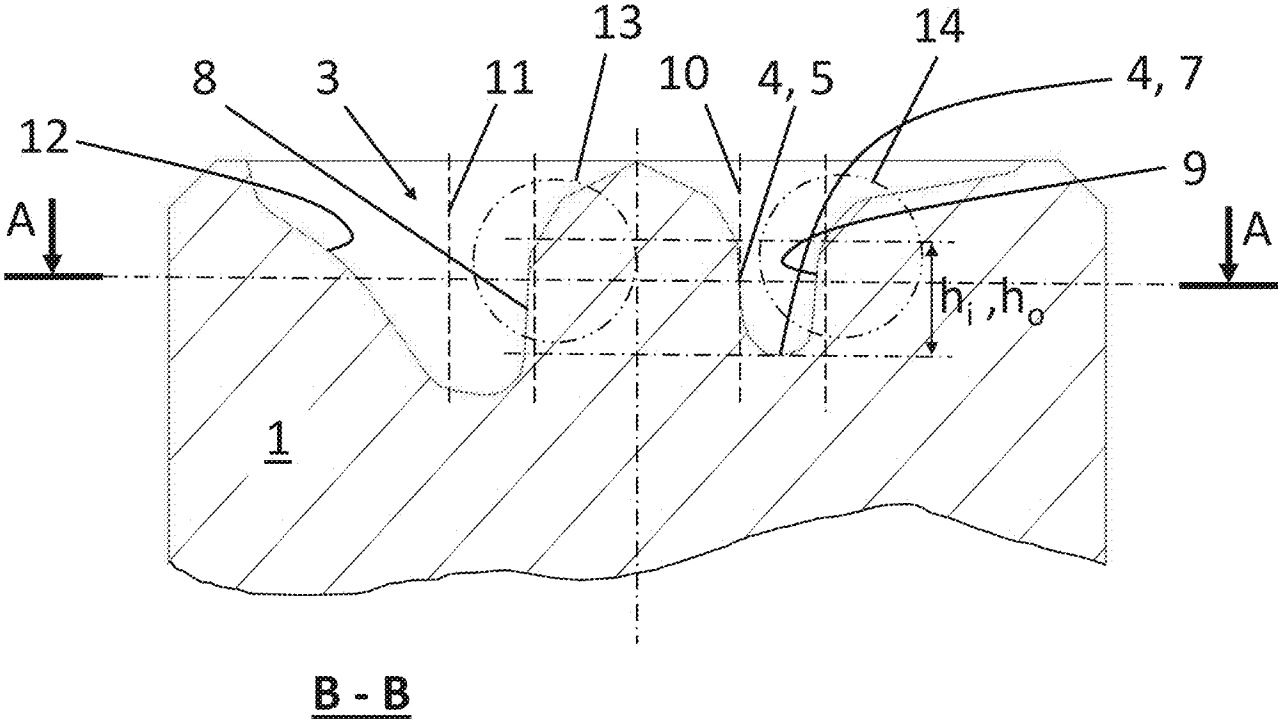
FIG. 3 illustrates a cross section B-B through the sonotrode according to FIG. 1 in a vertical plane.

FIG. 2 shows the contour lines of the inner and outer surface sections 5, 6 obtained by cutting the sonotrode according to FIG. 1 along a plane "A-A" perpendicular to the longitudinal axis 2. The position of the plane is indicated in FIG. 3 as dash-dotted cutting line between positions A and A. A first dashed line 10 continues the essentially circle-shaped contour of the inner surface section 5. Likewise, a second dashed line 11 continues the essentially circle-shaped contour of the outer surface section 5. These auxiliary lines serve to emphasize the internal and external ridges 8, 9.

Further, five indentation 12 are formed into the outer surface section 6. The numbers of the indentations 12 and the numbers of the inner ridges 8 is equal. Moreover, the angular positions of indentations 12 and of inner ridges 8 is equal with respect to the longitudinal axis 2. The internal ridges 8 and the external ridges 9 are arranged in an alternating manner with respect to a circumferential direction and the angular distances between all neighboring inner ridges 8 and between all neighboring outer ridges 9 around the longitudinal axis 2 are equal, namely 72°. A five-fold symmetry around the longitudinal axis is thus created.

As can be also seen in FIG. 2 a width $w_i$ of the internal ridges 8 in the circumferential direction is wider than a width $w_o$ of the external ridges 9 in the circumferential direction. Also, the internal ridges 8 are formed as blunt bulges while the external ridges 9 in cross section are formed as relatively sharp edges. While blunt-edged ribs are less susceptible to wear, the tooling for producing sharp-edged ribs is simpler.

Figure 4:
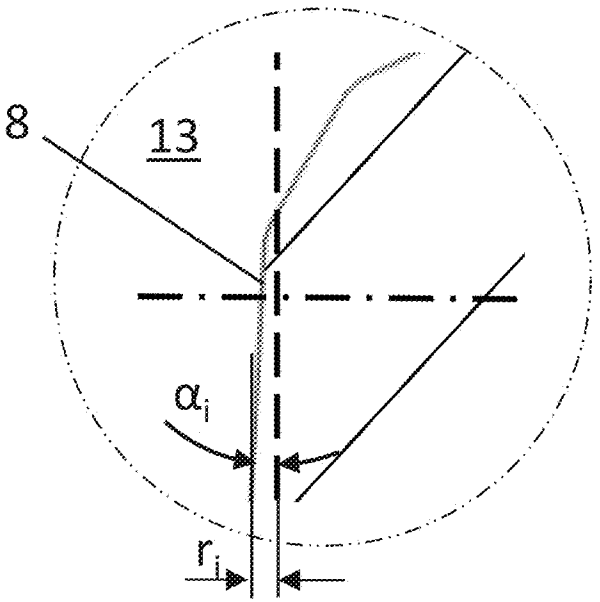
FIG. 4 illustrates an enlarged section of FIG. 3.
Figure 5:
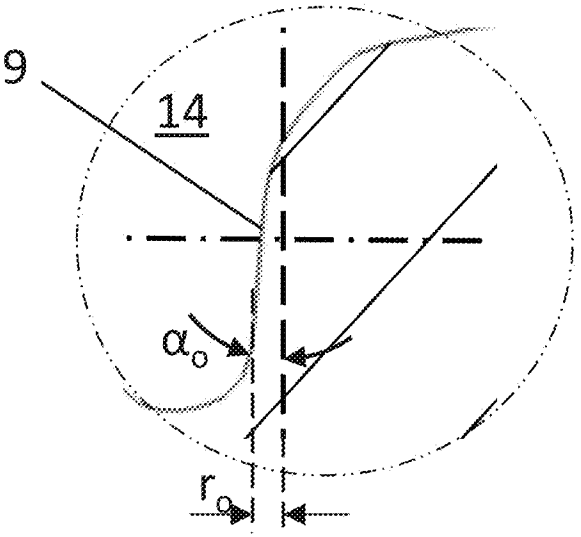
FIG. 5 illustrates another enlarged section of FIG. 3.

FIG. 3 shows the sonotrode according to FIG. 1 in a cross section along a plane "B-B" parallel to the longitudinal axis 2. The position of the plane is indicated in FIG. 2 as dash-dotted cutting line between positions B and B. As can be seen there the cross-sectional plane B-B runs through the center of both the internal ridges 8 and the external ridges 9. In FIG. 3, areas 13 and 14 are indicated, which are shown as enlarged sections in FIGS. 4 and 5. Accordingly, the following description refers equally to FIG. 3 to 5.

The internal ridges 8 comprise a radially outer crown section oriented in the plane B-B parallel to the longitudinal axis 2 an being inclined by a draft angle $\alpha_i$ from >0° to 15° relative to the longitudinal axis 2. Likewise, the external ridges 9 comprise a radially inner crown section oriented in the plane B-B parallel to the longitudinal axis 2 an being inclined by a draft angle $\alpha_o$ from >0° to 15° relative to the longitudinal axis 2. The internal ridges 8 protrude from the inner surface section 5 by a maximum depth $r_i$ of between 0.2 mm and 1.0 mm. Likewise, the external ridges 9 protrude from the outer surface section 6 by a maximum depth $r_o$ of between 0.2 mm and 1.0 mm.

Also shown in FIG. 3 is the height $h_i$ of the internal ridges and the external in the direction of the longitudinal axis measured from the lowest level of the bottom surface section 7 in the cross sectional plane B-B which preferably is in a range between 1.0 mm and 10.0 mm. Likewise the height $h_o$ of the external ridges in the direction of the longitudinal axis measured from the lowest level of the bottom surface section 7 in the cross sectional plane B-B which preferably is in a range between 1.0 mm and 10.0 mm.

Figure 6:
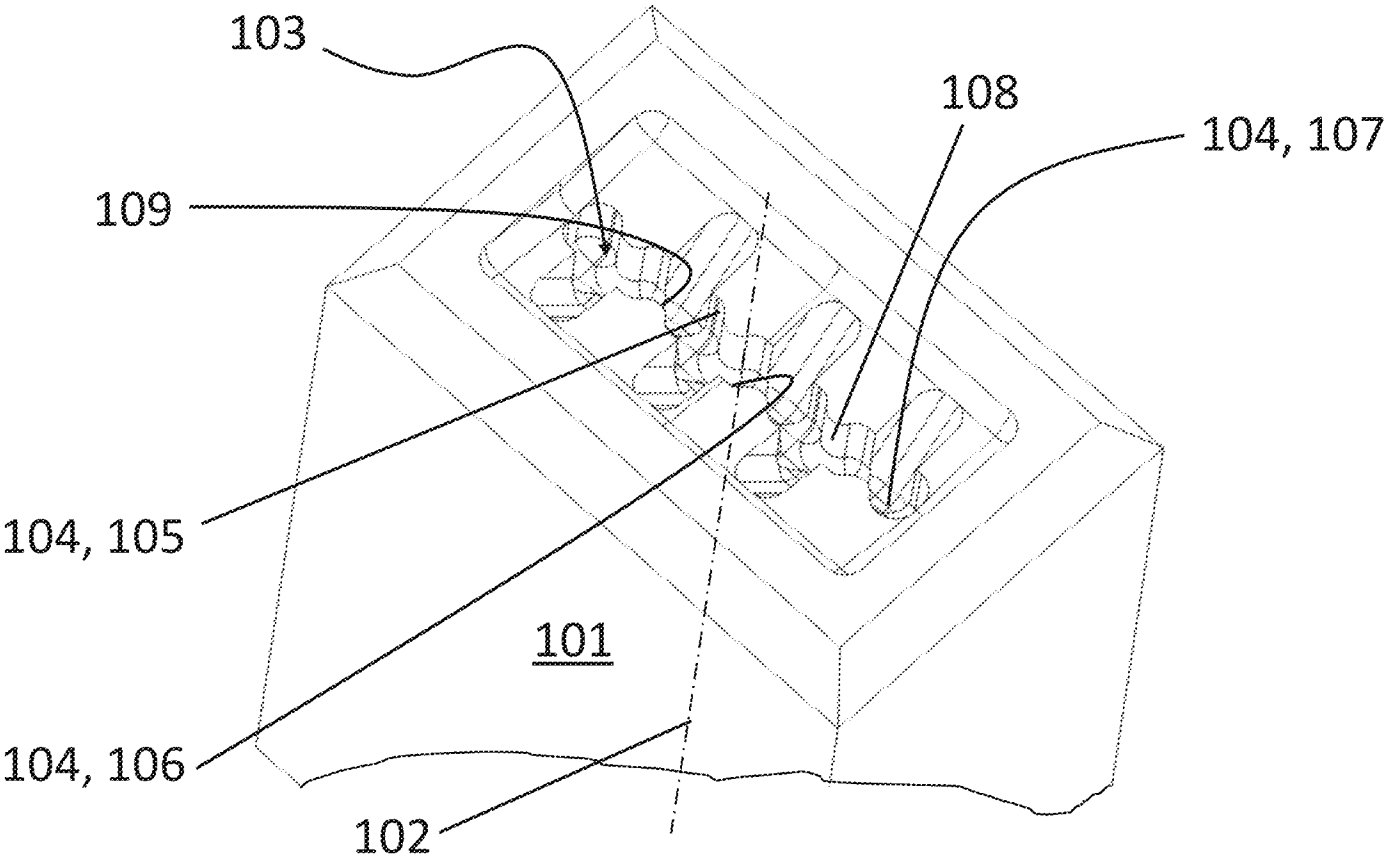
FIG. 6 illustrates a second embodiment of the sonotrode in accordance with the invention in a perspective sectional view.

FIG. 6 shows a sonotrode 101 according to another embodiment in accordance with the third aspect of the invention. The sonotrode according to this embodiment, in contrast to the previously discussed embodiment, has an essentially rectangular circumference.

The sonotrode 101 also defines a longitudinal axis 102 and comprises a cavity 103 having the negative shape of the closing head to be formed. The cavity provides a contact surface 104 designed to come in contact with the connecting element during reshaping. The contact surface 104 comprises two opposing side surface sections 105, 106 extending essentially parallel to the long side of the rectangle. The contact surface 104 also comprises a bottom surface section 107 facing basically in the direction of the longitudinal axis 2. The contact surface 104 further comprises at least two ridges 108, 109 protruding from each of the opposing side surface sections 105, 106 in an alternating manner viewed along a direction parallel to the side surfaces, I.e. the ridges are arranged so that each ridge faces the opposing side surface sections 105, 106 at a location without a ridge. The ridges are oriented substantially in the direction of the longitudinal axis 2.

This time the width and the shape of the ridges 108 protruding from one of the opposing side surface sections 105 and the width of the ridges 109 protruding from the other of the opposing side surface sections 106 are identical.

REFERENCE SIGNS

1 sonotrode
2 longitudinal axis
3 cavity
4 contact surface
5 inner surface section
6 outer surface section
7 bottom surface section
8 internal ridge
9 external ridge
10 inner circumference of a cylindrical hollow post
11 outer circumference of a cylindrical hollow post
12 indentation
13 enlarged area
14 enlarged area
101 sonotrode
102 longitudinal axis
103 cavity
104 contact surface
105 side surface section
106 side surface section
107 bottom surface section
108 ridge
109 ridge
$\alpha_i$ draft angle
$\alpha_o$ draft angle
$h_i$ height of the internal ridge
$h_o$ height of the external ridge
$r_i$ maximum depth of the internal ridge
$r_o$ maximum depth of the external ridge
$w_i$ width of the internal ridge
$w_o$ width of the external ridge

What is claimed is:

1. A sonotrode for reshaping a connecting element to form a closing head of a rivet comprising:

a cavity at least partially having the negative shape of the closing head to be formed;

wherein the sonotrode defines a longitudinal axis;

wherein the cavity is generally ring-shaped and provides a contact surface designed to come in contact with the connecting element during reshaping, the contact surface comprising a radially outwardly facing inner surface section and a radially inwardly facing outer surface section;

and wherein the contact surface comprises at least two internal ridges formed as blunt bulges and oriented substantially in the direction of the longitudinal axis and protruding radially outwardly from the inner surface section.

2. The sonotrode according to claim 1, comprising at least two external ridges oriented substantially in the direction of the longitudinal axis and protruding radially inwardly from the outer surface section.

3. The sonotrode according to claim 2, wherein the internal ridges and the external ridges are arranged in an alternating manner with respect to a circumferential direction.

4. The sonotrode according to claim 3, wherein the angular distances between all neighboring internal and external ridges around the longitudinal axis are equal.

5. The sonotrode according to claim 3, wherein a number of indentations are formed into the outer surface section, wherein the number of indentations and the number of the internal ridges is equal, and wherein the angular positions with respect to the longitudinal axis of indentations and of the internal ridges is equal.

6. The sonotrode according to claim 2, wherein a width of the internal ridges in the circumferential direction is wider than a width of the external ridges in the circumferential direction.

7. The sonotrode according to claim 2, wherein the external ridges comprise a radially inner crown section oriented in a plane parallel to the longitudinal axis an being inclined by an angle of >0° to 15° relative to the longitudinal axis.

8. The sonotrode according to claim 2, wherein the external ridges protrude by a maximum depth $r_o$ of between 0.1 mm and 2.0 mm from the outer surface section.

9. The sonotrode according to claim 2, wherein the internal ridges and the external ridges extend in the direction of the longitudinal axis over a length of between 1.0 mm and 10.0 mm.

10. The sonotrode according to claim 1, wherein the internal ridges comprise a radially outer crown section oriented in a plane parallel to the longitudinal axis an being inclined by an angle of >0° to 15° relative to the longitudinal axis.

11. The sonotrode according to claim 1, wherein the internal ridges protrude by a maximum depth $r_i$ of between 0.1 mm and 2.0 mm from the inner surface section.

12. A sonotrode for reshaping a connecting element to form a closing head of a rivet, wherein the connecting element defines a center axis and is at least partially formed by a tubular wall with an inner circumferential face, an outer circumferential face and an end face, the sonotrode comprising:

a cavity at least partially having the negative shape of the closing head to be formed, wherein the sonotrode defines a longitudinal axis being able to be aligned with the center axis of the connecting element;

wherein the cavity is generally ring-shaped and provides a contact surface designed to come in contact with the connecting element during reshaping, the contact surface comprising a radially outwardly facing inner surface section and a radially inwardly facing outer surface section;

wherein the contact surface comprises at least two internal ridges formed as blunt bulges and oriented substantially in the direction of the longitudinal axis and protruding radially outwardly from the inner surface section, and wherein the least two internal ridges are configured to make a first contact with the inner circumferential face during reshaping.

13. A sonotrode according to claim 12, comprising at least two external ridges oriented substantially in the direction of the longitudinal axis and protruding radially inwardly from the outer surface section.

14. A sonotrode for reshaping a connecting element to form a closing head of a rivet comprising:

a cavity at least partially having the negative shape of the closing head to be formed;

wherein the sonotrode defines a longitudinal axis;

wherein the cavity provides a contact surface designed to come in contact with the connecting element during reshaping, the contact surface comprising two opposing side surface sections;

and wherein the contact surface comprises at least two ridges protruding from each of the opposing side surface sections in an alternating manner, the ridges being formed as blunt bulges and oriented substantially in the direction of the longitudinal axis.

15. A sonotrode according to claim 14, comprising at least two external ridges oriented substantially in the direction of the longitudinal axis and protruding radially inwardly from the outer surface section.

16. A method of reshaping a connecting element to form a closing head of a rivet, the method comprising:

providing a connecting element, the connecting element defining a center axis and being at least partially formed by a tubular wall with an inner circumferential face, an outer circumferential face and an end face;

providing a sonotrode according to claim 1, wherein the longitudinal axis of the sonotrode is aligned with the center axis of the connecting element;

moving the sonotrode and the connecting element along the longitudinal axis relatively towards each other, thereby initially bringing the at least two internal ridges in contact with the inner circumferential face, applying an ultrasonic vibration via said sonotrode to the connecting element thereby initially softening or melting the material of the connecting element in the region of the initial contact.

17. The method according to claim 16, wherein the contact surface further comprises a bottom surface section, and wherein after initial contact the sonotrode and the connecting element are further moved along the longitudinal axis relatively towards each other, thereby bringing the end face of the connecting element in contact with the bottom surface section.

18. The method according to claim 17, whereby after bringing the end face of the connecting element in contact with the bottom surface section the sonotrode and the connecting element are further moved along the longitudinal axis relatively towards each other, thereby direct softened material or melt to flow along the outer circumferential face of the connecting element.

19. A method of reshaping a connecting element to form a closing head of a rivet, the method comprising:

providing a connecting element, the connecting element defining a normal axis and being at least partially formed by an elongated wall with two opposing side faces and an end face;

providing a sonotrode according to claim 14, wherein the longitudinal axis of the sonotrode is aligned with the normal axis of the connecting element;

moving the sonotrode and the connecting element along the longitudinal axis relatively towards each other, thereby initially bringing the at least two ridges on each of the opposing side surface sections in contact with the opposing side faces, applying an ultrasonic vibration via said sonotrode to the connecting element thereby initially softening or melting the material of the connecting element in the region of the initial contact.

20. A method of reshaping a connecting element to form a closing head of a rivet, the method comprising:

providing a connecting element, the connecting element defining a center axis and being at least partially formed by a tubular wall with an inner circumferential face, an outer circumferential face and an end face;

providing a sonotrode according to claim 12, wherein the longitudinal axis of the sonotrode is aligned with the center axis of the connecting element;

moving the sonotrode and the connecting element along the longitudinal axis relatively towards each other, thereby initially bringing the at least two internal ridges in contact with the inner circumferential face, applying an ultrasonic vibration via said sonotrode to the connecting element thereby initially softening or melting the material of the connecting element in the region of the initial contact.

* * * * *